United States Patent [19]

Hatfield

[11] Patent Number: 4,809,571

[45] **Date of Patent: * Mar. 7, 1989**

[54] AUTOMATIC FAST TAKE UP FOR USE WITH RATCHET HAND TOOL

[75] Inventor: John G. Hatfield, Camp Hill, Pa.

[73] Assignee: AMP Incorporated, Harrisburg, Pa.

[ * ] Notice: The portion of the term of this patent subsequent to May 10, 2005 has been disclaimed.

[21] Appl. No.: 87,020

[22] Filed: Aug. 19, 1987

[51] Int. Cl.[4] ..... B25B 7/12

[52] U.S. Cl. ..... 81/355; 81/357; 81/359

[58] Field of Search ..... 81/357, 356, 355, 314, 81/347, 352, 353, 354, 359; 72/410; 30/189, 193, 245, 258, 135; 140/93 A, 93.2, 93.4

[56] References Cited

U.S. PATENT DOCUMENTS

| | | | |
|---|---|---|---|
| 179,678 | 4/1856 | Over | 98/46 |
| 1,454,917 | 5/1923 | Barrett | 30/249 |
| 2,800,042 | 7/1957 | Demler | 81/15 |
| 2,829,549 | 4/1958 | Demler | 29/751 |
| 2,892,368 | 6/1959 | Demler | 81/15 |
| 2,947,207 | 8/1960 | Demler | 81/15 |
| 3,001,426 | 9/1961 | Demler | 81/15 |
| 3,328,871 | 7/1967 | Over | 29/203 |
| 3,359,779 | 12/1967 | Filia | 72/412 |
| 3,492,854 | 2/1970 | Eppler et al. | 72/412 |
| 3,922,783 | 12/1975 | Hayes | 30/250 |
| 4,080,820 | 3/1978 | Allen | 81/355 |
| 4,178,682 | 12/1979 | Sadauskas | 30/250 |
| 4,185,519 | 3/1980 | Hays et al. | 74/577 S |
| 4,186,484 | 2/1980 | Tanaka | 30/92 |
| 4,221,048 | 9/1980 | Parramore | 30/135 |
| 4,677,748 | 7/1987 | Kobayashi | 30/250 |

FOREIGN PATENT DOCUMENTS

| | | |
|---|---|---|
| 669674 | 12/1965 | Belgium . |
| 0058375 | 2/1982 | European Pat. Off. . |
| 1490170 | 1/1964 | Fed. Rep. of Germany . |
| 3205110 | 2/1982 | Fed. Rep. of Germany . |
| 1181307 | 1/1959 | France . |
| 2342115 | 2/1976 | France . |
| 2321985 | 8/1976 | France . |
| 2389459 | 5/1978 | France . |
| 87/07553 | 12/1987 | PCT Int'l Appl. . |

OTHER PUBLICATIONS

Model MVS-3 Tool, #156539, 11-21-79.
"T" Head Tool, #151610, 8-26-87.
"T" Head Tool #CA35-555-15M, 6-20-55.

*Primary Examiner*—Frederick R. Schmidt
*Assistant Examiner*—Blynn Shideler
*Attorney, Agent, or Firm*—Bruce J. Wolstoncroft

[57] ABSTRACT

A multiple stroke hand tool (2) comprises a ram (18) slidably mounted to a housing frame (44). A compact rotatable ratchet member (30) is connected to the ram (18) and pivotally mounted to the housing frame (44) such that as operating means (90) are moved, a drive pawl (32) engages the ratchet member (30) causing the ratchet member (30) to rotate, which in turn causes the ram (18) to move between an open position and a closed position. An automatic fast take-up member (60) is provided which cooperates with the operating means (90). This type of automatic fast take-up allows minimal operator input, enabling the operator to better perform the other operation required. This fast take-up member (60) also insures that terminals are properly positioned with respect to the ram (18), thereby providing a much more reliable operation of the hand tool (2).

18 Claims, 3 Drawing Sheets

AUTOMATIC FAST TAKE UP FOR USE WITH RATCHET HAND TOOL

FIELD OF INVENTION

The invention relates to an automatic fast take up for use with a ratchet hand tool. The fast take up allows for the operation of the hand tool using only one hand, thereby insuring that the wire will be properly positioned in the exchangeable dies when crimping, etc. is to occur.

BACKGROUND OF THE INVENTION

A wide variety of hand grip tools are known in the industry. Many of these tools are designed to do a specific operation while others are designed to do many operations through the use of changeable mating die halves. Such hand tools are generally either double action hand tools (DAHT) which have dies that close in an arc-like path or straight action hand tools (SAHT) which have straight line die movement.

The majority of recent hand tools are of the multiple stroke hand tool type. These hand tools provide greater mechanical advantage than the previous single stroke hand tools. The mechanical advantage is provided through the use of a ratchet member driven by the movement of the handles as they are displaced toward each other. This mechanical advantage allows the handle of the hand tool to be positioned such that maximum grip strength of the operator corresponds with the maximum input force required for operation.

However, a problem with the above-mentioned multiple stroke hand tools is that no easy, convenient means is provided to allow the dies to be moved quickly and automatically into position adjacent the wire, prior to the operation being performed. Positioning the dies adjacent to the wire is important if the dies are to maintain the wire in the proper position as the operation occurs. The hand tools provided essentially two options of moving the dies into the proper position adjacent the wire. First, the handles of the ratchet hand tool must be engaged the proper number of times, in order to insure that the dies are adjacent to the wire before the operation is begun. The second manner of moving the dies into the required adjacent position is to provide a lever which can be operated by the operator. However, this requires that the operator use two hands, or that the operation use one hand to perform many operations.

The problem is that either option takes time and operator skill to perform. If either option is done improperly, a nonacceptable crimp, etc. will be performed. increasing the time or complexity of the operator procedure will only allow for more human error to cause more wasted material. Therefore, the present invention is directed to an automatic fast take-up which uses minimal operator input to position the dies in the proper position adjacent the wire, etc.

SUMMARY OF THE INVENTION

An object of the present invention is to provide a compact multiple stroke hand tool with an automatic fast take-up member which cooperates with the operating means of the hand tool. This enable minimal operator input, enabling the operator to better perform the other operations required. This fast take-up member also insures that the terminals are properly aligned, thereby providing much more reliable crimps, etc.

The hand tool is comprised of a housing frame. A ram is slidably mounted to the housing frame such that the ram may be moved between an open position and a closed position, A rotatable ratchet member is pivotally mounted to the housing frame and is connected to the ram, such that as a drive pawl engages the ratchet member, the ratchet member is rotated between a first position and a second position and the ram is linearly moved between the open position and the closed position.

The tool is characterized in that a fast take-up member is pivotally attached to the ratchet member. The fast take-up member causes the ratchet member to move from the first position toward the second position as the drive means is engaged to move to the closed position.

Whereby as the drive means is first moved from the open position to the closed position, the fast take-up means is engaged. This causes the ratchet member to move from the first position toward the second position. As the motion of the drive means is repeated between the open position and the closed position, the fast take-up means is disengaged from the drive means. The drive means then causes the ratchet member to be moved to the second position.

DETAILED DESCRIPTION OF THE INVENTION

Figure 1:
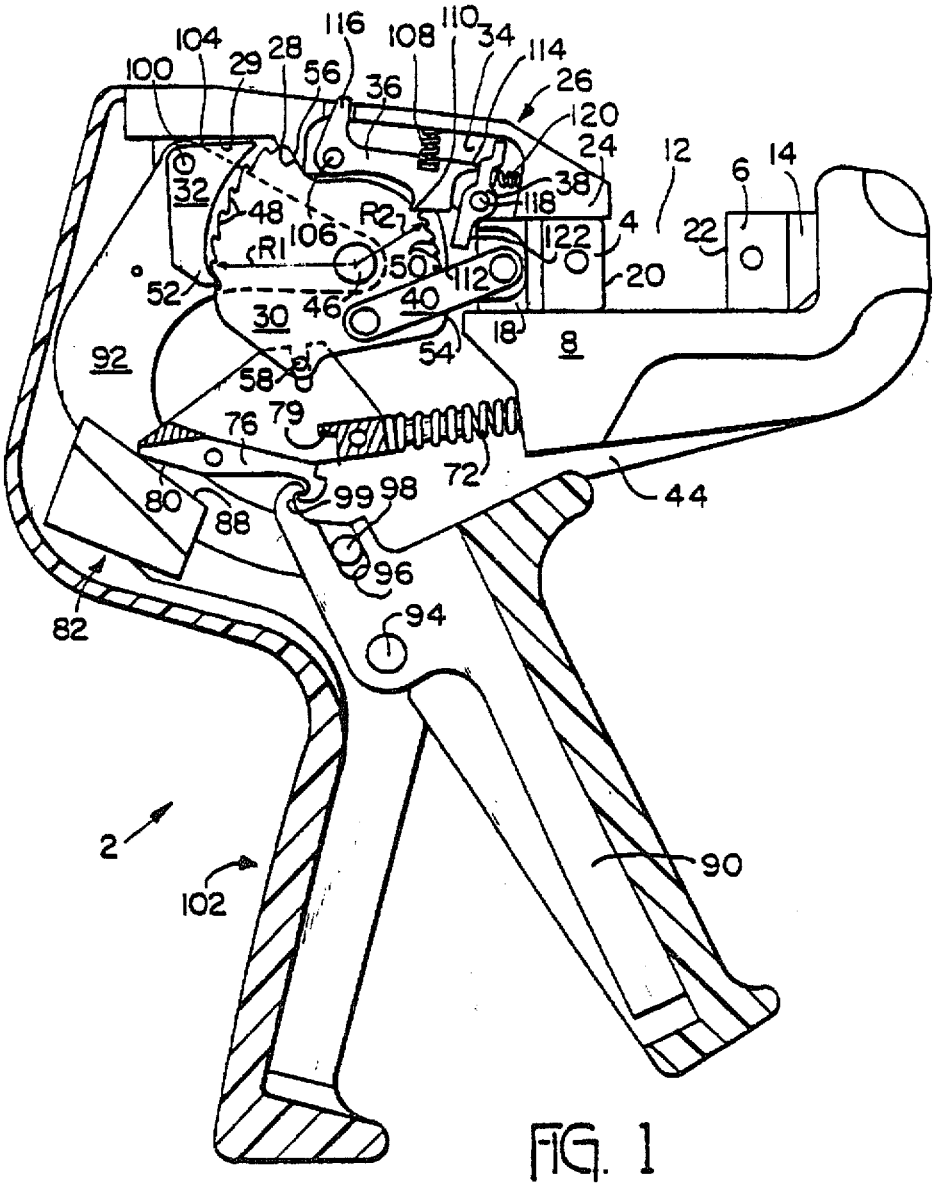
FIG. 1 is a side view of a hand tool of the present invention showing the hand tool in an assembled condition with a portion of the housing frame removed.

A hand tool 2 of the present invention is designed to allow interchangeable mating die halves 4, 6 to be used. This permits hand tool 2 to perform many operation on a wire, including, but not limited to, cutting, crimping, swagging, and gripping. These operations correspond to the mating die halves 4, 6 used in hand tool 2. However, although many different mating die halves 4, 6 are effective, for ease of explanation, crimping die halves 4, 6 will be used in the description of hand tool 2.

Before going into a detailed description of the hand tool 2 of the present invention, it is helpful to note that much of the operation of hand tool 2, and many of the parts thereof are identical to that of the hand tool 2 described in copending U.S. patent application Ser. No. 871,235, file June 6, 1986 now U.S. Pat. No. 4,742,737. This application is hereby incorporated by reference.

A support member 8 is positioned proximate end of opening 12. Support member 8 is used to secure block 14 in position at the end of opening 12. Block 14 in turn cooperates with die half 6 to position and maintain die half 6 in the proper orientation.

As shown in FIG. 1, support member 8 defines two surfaces of opening 12. A groove, not shown, is provided on the inside of support member 8, such that the groove cooperates with a ram 18 to allow ram 18 to slidably move therealong. Ram 18 is aligned with opening 12 such that mating die half 4 may be mounted onto ram 18 and secured thereon. As shown in FIG. 1, block 14 and ram 18 are positioned proximate opposed ends of opening 12 when hand tool 2 is in an open position. With die halves 4, 6 in position and a terminal and a wire positioned between die halves 4, 6, ram 18 and die hal 4 are slidably moved to a closed position, in which a bottom surface 20 of die half 4 engages a second surface 22 of die half 6, causing die halves 4, 6 to cooperate with each other to crimp the terminal to the wire.

An end section 24 of a pawl carrier 26 is provided adjacent opening 12, opposite support member 8, as shown in FIG. 1. End section 24 cooperates with support member 8 to maintain ram 18 in place. Pawl carrier 26 extends away from opening 12 to provide stop surfaces 28, 29 for a ratchet member 30 and a drive pawl 32, as will be discussed. A cavity 34 is provided in carrier 26 in which latching pawl 36 and latch 38 are mounted. A plate (not shown) covers cavity 34 thereby securing latching pawl 36 and latch 38 in cavity 34.

Links 40 are pivotally connected at pivots to ram 18 and ratchet member 30 respectively, as shown in FIG. 1. It should be noted that a link 40 is provided on either side of ratchet member 30. This configuration allows links 40 to transfer the rotary motion of ratchet member 30 into a linear motion of ram 18. Consequently, allowing die half 4 is moved toward die half 6 in such a manner that the force required to crimp the terminal is applied equally across the terminal and the wire. This linear type action defines hand tool 2 as a straight action hand tool.

Ratchet member 30 is provided to move link 40 as discussed above. To this end, ratchet member 30 is rotatably mounted to housing frame 44 at a pivot 46. A coil spring 72 is provided proximate ratchet member 30 and provides the resilient force necessary to operate ratchet member 30. Spring 72 is at rest when ram 18 is in the open position, which corresponds to a first position of ratchet member 30. As ratchet member 30 is rotated to a second position, spring exerts a spring force on ratchet member 30 through fast take-up device 60, as will be discussed.

The design of ratchet member 30 utilizes minimal space while ensuring a reliable, effective means of operation. In order to accomplish this, ratchet member 30 is provided with drive teeth 48 positioned a distance R1 from pivot and latching teeth 50 positioned a distance R2 from pivot, such that R1>R2. As R1 is increased, less force is required from a projection 52 of drive pawl 32 to drive ratchet member 30 in order to generate the force necessary to crimp the terminal to the wire. The distance R1 is therefore critical to prevent the generation of large forces on drive teeth 48 and projection 52 which could result in a failure thereof. Latching teeth 50 are positioned a shorter distance R2 away from pivot 46 because latching teeth 50 merely act to hold ratchet member 30 in place. Therefore, latching teeth 50 do not have the large force associated with them. The distances R1 and R2 are designed such that the forces applied will not result in a failure of hand tool 2. However, R1 and R2 are also designed so that ratchet member 30 occupies a minimal amount of space which results in a reliable compact hand tool 2 that has a long useful life.

A release surface 54 is provided on ratchet member 30 adjacent latching teeth 50, and a stop surface 56 is provided on ratchet member 30 adjacent drive teeth 48. Release surface 54 cooperates with latching pawl 36 and stop surface 56 cooperates with stop surface 28 of carrier 26, as will be discussed.

Figure 4:
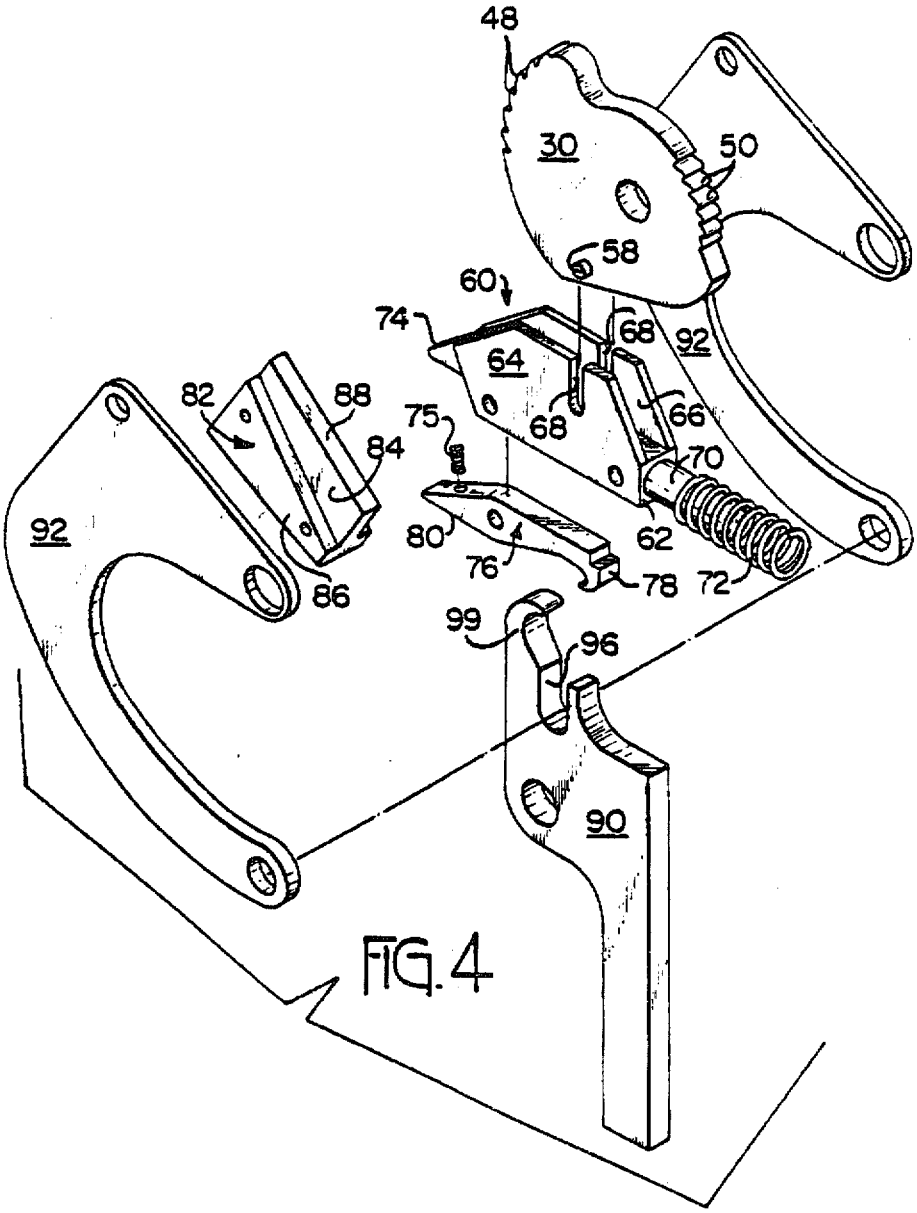
FIG. 4 is an exploded perspective view of the component parts shown in FIGS. 2 and 3.

A pin 58 is provided on either side of ratchet member 30 to cooperate with a fast take-up device 60. Fast take-up device 60, as best shown in FIG. 4, has a base portion 62 with two plates 64, 66 extending therefrom. Plates 64, 66 are essentially parallel to each other and are spaced apart such that ratchet member 30 can be placed therebetween. Plates 64, 66 have slots 68 provided therein, slots 68 cooperate with pin 58 of ratchet member 30. A cylindrical projection 70 extends from base portion 62 and cooperates with a spring 72. The spring 72 is attached to an opening (not shown) provided in support member 8. Extending from the base portion 62, in the opposite direction from projection 70 is a triangular projection 74. Triangular projection 74 has a spring 75 extending therefrom, spring 75 cooperates with fast take-up pawl 76, as will be discussed. Fast take-up pawl 76 is pivotally mounted to plates by a pin (not shown). Fast take-up pawl 76 is provided with hook like projections 78 at one end and a stop surface 80 at the other end. Stop surface 79 cooperates with pawl 76, as will be discussed.

A camming member 82 is provided on housing frame 44. Camming member 82, as best shown in FIG. 4, has a narrow surface 84 which projects from main portion 86. An end surface 88 of narrow portion 84 acts as a camming surface for fast take-up pawl 76.

To generate the required force necessary to crimp the wire, a movable handle 90 cooperates with drive plates 92, the drive plates in turn cooperate With drive pawl 32 to generate the required mechanical advantage. Handle 90 is pivotally mounted at one end by a pin 94 to housing frame 44, and serves principally as a drive lever. Slot 96 provided at the end of handle 90 cooperates with pin 98 of plates 92, such that as handle 90 is moved, plates 92 are moved accordingly. Plates 92 are pivotally mounted to housing frame 44 at pivot 46. Drive pawl 32 is pivotally mounted to plates 92 via a pin 100 and is positioned to act in the well-known manner of such pawl devices upon ratchet member 30. Also provided on the pivotally mounted end of handle 90 is a hook like projection 99.

Handle is biased away from stationary handle 102. Drive pawl 32 is biased toward ratchet member 30. This combination allows projection 52 of drive pawl 32 to cooperate with drive teeth 48 to drive ratchet member 30, as handle 90 is moved toward handle 102. However, when handle 90 is not displaced, as shown in FIG. 1, an end surface 104 of drive pawl 32 engages stop surface 29 of carrier 26 causing drive pawl 32 to pivot about pin 100, thereby resulting in pawl being positioned out of engagement with drive teeth 48 of ratchet member 30.

Latching pawl 36 is pivotally mounted on carrier 26 by pin 106. Spring 108 in engagement with pawl 36 and carrier 26, urges pawl 36 toward ratchet member 30. A lower projection 110 of pawl 36 is engageable with latching teeth 50 of ratchet member 30 to prevent backward rotation of ratchet member 30, as will be discussed. An engagement surface 112 and a projection 114 are provided on latching pawl 36 for cooperation with ratchet member 30 and latch 38 respectively. A release portion 116 of pawl extends through an opening of carrier 26 to allow manual release of latching pawl 36 from ratchet member 30.

Latch 38 is pivotally mounted on carrier 26 via pin 118. Spring 120 is mounted in engagement with latch 38 and carrier 26, urging a portion of latch 38 toward latching pawl 36. A contact surface 122 is provided at an end of latch 38 opposite the portion of the latch which is biased toward latching pawl 36.

In operation, hand tool 2 is used for crimping a respective terminal to a respective wire. As was previously described, mating die halves 4, 6 are secured to ram 18 and block 14 respectively. The terminal and wire are then inserted into opening 12 of housing frame 44 such that the terminal and the wire are positioned between mating die halves 4, 6. However, in this initial position there is nothing, other than the hand of the operator, to accurately position and maintain the terminal or the wire in the proper crimping position. Consequently, a means to accurately maintain the terminal in the proper orientation is essential in order to insure that a reliable crimp is performed between the terminal and the wire. This is the purpose of fast take-up device 60.

Figure 2:
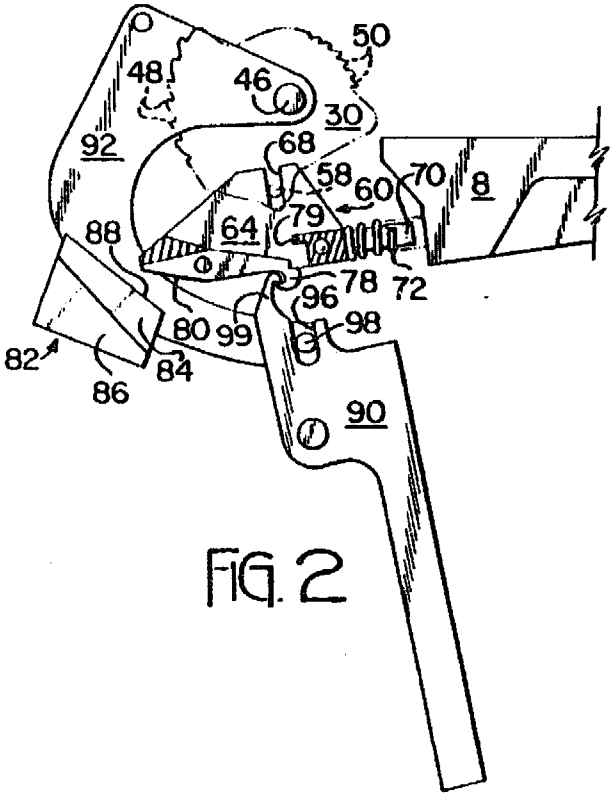
FIG. 2 is a fragmentary view of some of the component part of the hand tool showing the motion of a fast take-up device of the present invention.

With the terminal held in opening 12 by one hand of the operator, handle 90 is displaced toward stationary handle 102 by the other hand of the operator. In so doing hook like projection 99 of handle 90 is forced to move, as indicated in by the change of position shown between FIG. 1 and FIG. 2. As hook like projection 99 of handle 90 and hook like projection 78 of fast take-up device 60 are in engagement, the movement of hook like projection 78 corresponds to the movement of hook like projection 99. Consequently, as handle 90 is displaced, hook like projection 78, as well as the entire fast take-up device 60, is forced to move forward as shown in FIG. 2. As fast take-up device 60 is moved forward, ratchet member 30 is rotated. This rotation is caused by the cooperation of slots 68 of fast take-up device 60 with pins 58 of ratchet member 30. The rotation of ratchet member 30 causes ram 18 and die half 4 to move toward block 14 and die half 6. This motion continues until die halves 4, 6 are placed in engagement with the terminal. This allows the terminal to be maintained in the proper orientation as the crimping is done. To perform the actual process of crimping, more force is required than can be generated by fast take-up device 60.

Figure 3:
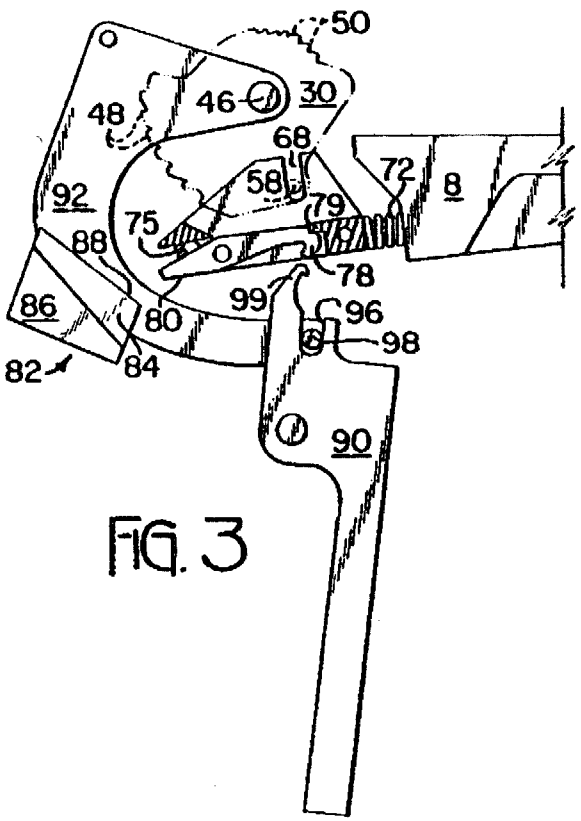
FIG. 3 is a view similar to that of FIG. 2 showing the same parts at a time when a ratchet member is nearing a second position.

Once die halves 4, 6 are in engagement with the terminal, handle 90 is released, allowing handle 90 to return to its original position, as shown in FIG. 1. However, fast take-up device 60 does not return to its original position. This is because fast take-up device 60 is attached to ratchet member 30, and ratchet member 30 is prevented from backward motion by the cooperation of latching pawl 36 with latching teeth 50. Consequently, as handle 90 is allowed to return to its original position, hook like projection 99 of handle 90 disengages from hook like projection 78 of fast take-up device 60. This allows spring 75 to resiliently urge fast take-up pawl 76 against stop surface 79, as shown in FIG. 3. In this position, no portion of fast take-up pawl 76 extends beyond the bottom surface of base 62 of fast take-up device 60. In this position, hook like projection 78 of fast take-up device 60 will not engage hook like projection 99 of handle 90.

To proceed further, handle 90 is again displaced toward stationary handle 102. In so doing, drive pawl 32 is resiliently urged to engage drive teeth 48 of ratchet member 30. As handle 90 is further displaced, ratchet member 30, in engagement with drive pawl 32, is forced to move accordingly. This process is continued until handle 90 reaches a maximum displacement which corresponds to the displacement which is necessary for the terminal to be crimped to the wire. Once this point has been reached, latching pawl 36 is released from latching teeth 50, as was described in the earlier filed application. This permits all of the various parts of hand tool 2 to return to their original position, as shown in FIG. 1. Consequently, drive pawl 32 returns toward its original position. However drive pawl 32 does not return to its original position until surface 104 of drive pawl 32 engages stop surface 29 of carrier 26, which causes drive pawl 32 to disengage from ratchet member 30 and return to its original position, as shown in FIG. 1.

Fast take-up is returned to its original position by ratchet member 30 and spring 72. As latching pawl 36 is released from ratchet member 30, ratchet member 30 is resiliently returned toward camming member 82. As pins 58 cooperate with fast take-up device 60, fast take-up device 50 is also returned toward its original position. This return motion is facilitated by the resilient nature of spring 72. The original position of fast take-up device 60 is not reached until stop surface 80 engages end surface 88 of camming member 82, causing fast take-up pawl 76 to pivot to the position shown in FIG. 1. In this original position hook like projections 78 and 99 cooperate in the manner described. Hand tool 2 is again in position to crimp another terminal to another wire.

The hand tool of the present invention has the desirable advantage of complete one hand operation, which frees the second hand of the operator to hold the terminal and wire in position until required. The fast take-up means is not activated by a lever which is distant from the handle, the fast take-up is activated using the same handle which is used to crimp the terminal to the wire. It is also important that the hand tool of the invention is reliable and accurate. Consequently, in this day of minimized scrap and ease of operation, the hand tool described herein is configured for ease of operation and reliability of service.

I claim:

1. A hand tool comprising:

a housing frame;

a ram slidably mounted to the housing frame such that the ram is moved between an open position and a closed position;

a ratchet member pivotally mounted to the housing frame, the ratchet member being moved between a first position and a second position corresponding to the open and closed position of the ram;

means for moving the ratchet member, the means being movable between an open position and a closed position;

a return means which cooperates with the housing frame such that as the ratchet member is moved, the member is deformed, thereby exerting pressure on the ratchet member to return the ratchet member to the first position;

means connecting the ram to the ratchet member so that as the ratchet member is moved, the ram slides from the open position to the closed position;

latching means mounted on the housing frame and having a contact portion for engagement with the ratchet member thereby preventing the member from causing unwanted backward movement of the ratchet member; and fast take-up means which cooperate with the means for moving the ratchet member such that as the means for moving the ratchet member are engaged, the fast take-up means move the ram from the open position to proximate the closed position.

2. A hand tool as recited in claim 1 wherein a contacting surface is provided on the ratchet member such that when the ratchet member is fully moved, the contacting surface will engage an engagement surface of the latching means thereby forcing the contact portion of the latching means to disengage from the ratchet member permitting the returning means to return the ratchet member to the first position.

3. A hand tool as recited in claim 1 wherein an engagement projection connected to the latching means extends outward from the housing frame, such that upon manual contact of the engagement projection, the contact portion of the latching means may be disengaged from the ratchet member thereby permitting the ratchet member to return to the first position.

4. A hand tool as recited in claim 1 wherein the fast take-up means has a base member having slots provided therein, a projection extending from one side thereof, and a fast take-up pawl which is pivotally connected to the base member.

5. A hand tool as recited in claim 4 wherein the fast take-up pawl has a hook like projection extending from an end thereof, the hook like projection cooperating with a similar hook like projection extending from an end of the means for moving the ratchet member, whereby the hook like projections engage each other such that as the means for moving the ratchet member is moved from the open position to the closed position, the fast take-up means cooperates to move the ram toward its closed position.

6. A hand tool as recited in claim 5 wherein the hook like projections disengage from each other after the ram has been moved partially toward the closed position, the hook like projection of the fast take-up means being resiliently moved by resilient means from the path of the hook like projection of the means for moving the ratchet member.

7. A hand tool as recited in claim 4 wherein the projection of the fast take-up means cooperates with a spring of the resilient means, such that as the ram reaches the closed position, the spring resiliently returns the fast take-up means toward the first position.

8. A hand tool as recited in claim 7 wherein a stop surface of the fast take-up pawl cooperates with a camming surface as the fast take-up means is returned toward the first position, the cooperation of the camming surface and the stop surface causes the fast take-up pawl to pivot, such that a hook like projection of the fast take-up pawl is moved into engagement with a hook like projection of the means for moving the ratchet member.

9. A hand tool as recited in claim 4 wherein projections are provided on the ratchet member, the projection cooperate with the slots of the base member of the fast take-up means, whereby as the fast take-up means is moved, the ratchet member must correspondingly move.

10. A tool comprising:

frame means having first and second means for movement toward and away from each other between an open position and a closed position;

movable means mounted on the frame means for movement between a first position and a second position;

return means for maintaining the movable means in the first position and returning the movable means to the first position when the movable means reaches the second position;

operating means operatively connected to the movable means for moving the movable means between the first and second positions;

latching means for engagement with the movable means during movement of the movable means, the latching means provided to maintain the movable means at different positions between the first and second positions; and fast take-up means operatively connected to the operating means, such that as the operating means is initially engaged, the fast take-up means will cause the movable means to move from the first position toward the second position, and as the operating means is initially released, the connection between the fast take-up means and operating means will be discontinued.

11. A tool as recited in claim 1 wherein a release means is provided to cooperate with the return means, such that the movable means may be manually returned to the first position.

12. A hand tool as recited in claim 10 wherein the fast take-up means has a base member having slots provided therein, a projection extending from one side thereof, and a fast take-up pawl which is pivotally connected to the base member.

13. A hand tool as recited in claim 12 wherein the fast take-up pawl has a hook like projection extending from an end thereof, the hook like projection cooperating with a similar hook like projection extending from an end of the operating means, whereby the hook like projections engage each other such that as the operating means is moved from the first position to the second position, the fast take-up means cooperates to move the second means toward its closed position.

14. A hand tool as recited in claim 13 wherein the hook like projections disengage from each other after the second means has been moved partially toward the closed position, the hook like projection of the fast take-up means being resiliently moved from the path of the hook like projection of the operating means by resilient means.

15. A hand tool as recited in claim 12 wherein the projection of the fast take-up means cooperates with a spring, of the return means such that as the second means reaches the closed position, the spring resiliently returns the fast take-up means toward the first position.

16. A hand tool as recited in claim 15 wherein a stop surface of the fast take-up pawl cooperates with a camming surface mounted on the housing frame as the fast take-up means is returned toward the first position, the cooperation of the camming surface and the stop surface causes the fast take-up pawl to pivot, such that a hook like projection of the fast take-up pawl is moved into engagement with a hook like projection of the operating means.

17. A hand tool as recited in claim 12 wherein projections are provided on the movable means, the projection cooperate with the slots of the base member of the fast take-up means, whereby as the fast take-up means is moved, the movable means must correspondingly move.

18. A hand tool comprising housing frame, a ram slidably mounted to the housing frame such that the ram may be moved between an open position and a closed position, a ratchet member pivotally mounted to the housing frame, means connecting the ram to the ratchet member, and drive means repeatedly movable between an open position and a closed position, such that as the drive means is repeatedly moved between the open position and the closed position, the ratchet member is moved between a first position and a second position, causing the ram to be moved between the open position and the closed position, the tool being characterized in that:

a fast take-up member is pivotally attached to the ratchet member, the fast take-up member causing the ratchet member to move from the first position toward the second position as the drive means is engaged to move to the closed position;

whereby as the drive means is first moved from the open position to the closed position, the fast take-up means is engaged causing the ratchet member to move from the first position toward the second position, as the motion of the drive means is repeated between the open position and the closed position, the fast take-up means is disengaged from the drive means, and the drive means causes the ratchet member to be moved to the second position.

* * * * *